United States Patent [19]

Elson et al.

[11] 4,153,392

[45] May 8, 1979

[54] REFRIGERATION COMPRESSOR LUBRICATION

[75] Inventors: John P. Elson, Sidney; Ernest R. Bergman, Rossburg, both of Ohio

[73] Assignee: Copeland Corporation, Sidney, Ohio

[21] Appl. No.: 787,380

[22] Filed: Apr. 14, 1977

[51] Int. Cl.[2] ..... F04B 17/00; F04B 35/00

[52] U.S. Cl. ..... 417/372; 184/6.18

[58] Field of Search ..... 417/372; 184/6.16, 6.18, 184/6.24

[56] References Cited

U.S. PATENT DOCUMENTS

| | | | |
|---|---|---|---|
| 2,963,113 | 12/1960 | Ayling | 417/372 X |
| 3,830,341 | 8/1974 | Davies | 417/372 X |

*Primary Examiner*—Carlton R. Croyle

*Assistant Examiner*—R. E. Gluck

*Attorney, Agent, or Firm*—Harness, Dickey & Pierce

[57] ABSTRACT

There is disclosed herein a lubrication system for a compressor which provides means for separating and flushing foreign particles contained in the lubricant so as to minimize the number of such particles being circulated through the lubrication system thereby reducing the possibility of damaging the bearings. The foreign particles are separated from the main lubricant flowpath by centrifugal forces and are flushed downwardly into collection means in the lower bearing housing and out through a passage provided therein back to the oil sump. An extension of this passage in the lower bearing housing is also adapted to cooperate with a portion of an axial thrust bearing to prevent rotation thereof.

13 Claims, 6 Drawing Figures

REFRIGERATION COMPRESSOR LUBRICATION

BACKGROUND AND SUMMARY OF THE INVENTION

The present invention relates generally to lubrication systems for compressors and more specifically to such lubrication systems including means for preventing lubricant entrained foreign particles from being circulated through the bearings of the compressor.

Refrigeration compressors generally provide a motor drivingly connected to one end of a crankshaft rotatably journaled in a housing and have compressor means connected to the opposite end thereof. Passages are provided in the crankshaft for supplying lubricant from a sump to each of the bearings supporting the crank. In order to insure extended trouble-free operation of these refrigeration compressors, it is extremely important to insure an adequate flow of lubricant to these bearings which is as free as possible from foreign particles which may cause excessive wear or scoring of the working surfaces. While these refrigeration compressors are generally hermetically sealed, foreign particles may enter the lubricant from a variety of sources such as during manufacture of the compressor or other system components, from wearing surfaces, or even during installation. Accordingly, it is desirable to provide a lubrication system having means for separating these foreign particles from the lubricant as it is pumped to the bearings.

In one such separating arrangement of which applicant is aware, an axial thrust bearing is provided with a radial groove which periodically communicates with an extension of an eccentric oil passage provided in the crank into which the foreign particles settle thereby allowing the particles to be returned to the oil sump. However, this system may not be fully effective as the extension of the oil passage is brought into communication with the radial groove only once for a brief period during each revolution of the crankshaft. This may be insufficient time to allow the particles to be flushed out of the extension thus allowing the particles to build up to a level where they are carried by the oil flow to the bearings or possibly even clog the extension passage thus totally defeating the system. Further, when only small quantities of particles are present, the repeated unrestricted flow of lubricant through this radial passage even for brief periods may result in oil starvation of the upper bearings.

The present invention, however, overcomes these problems in providing a lubrication system having means for separating foreign particles from lubricant flowing to the bearings which allow such particles to be continually flushed from the flow area. An axial thrust bearing is provided with a plurality of passages which communicate with a collection area provided in the lower bearing housing. Thus, the particles may pass out of the lubricant flowpath through numerous routes. Passage means are also provided in the lower bearing housing to allow excess lubricant to continuously flush at least a portion of the particles from the collection area back to the oil sump thus preventing any accumulation which could result in clogging of the system. Further, as neither the oil pump nor the eccentric supply passage communicates directly with the particle disposal passage, oil pressure is maintained substantially constant through the entire rotation of the crankshaft thus insuring an adequate continuous supply of oil to all the bearings. Also, an extension of the passage means is adapted to cooperate with a portion of the axial thrust bearing to prevent rotation thereof.

Additional advantages and features of the present invention will become apparent from the following description of the preferred embodiment taken in conjunction with the appended claims and drawings.

DESCRIPTION OF THE PREFERRED EMBODIMENT

Figure 1:
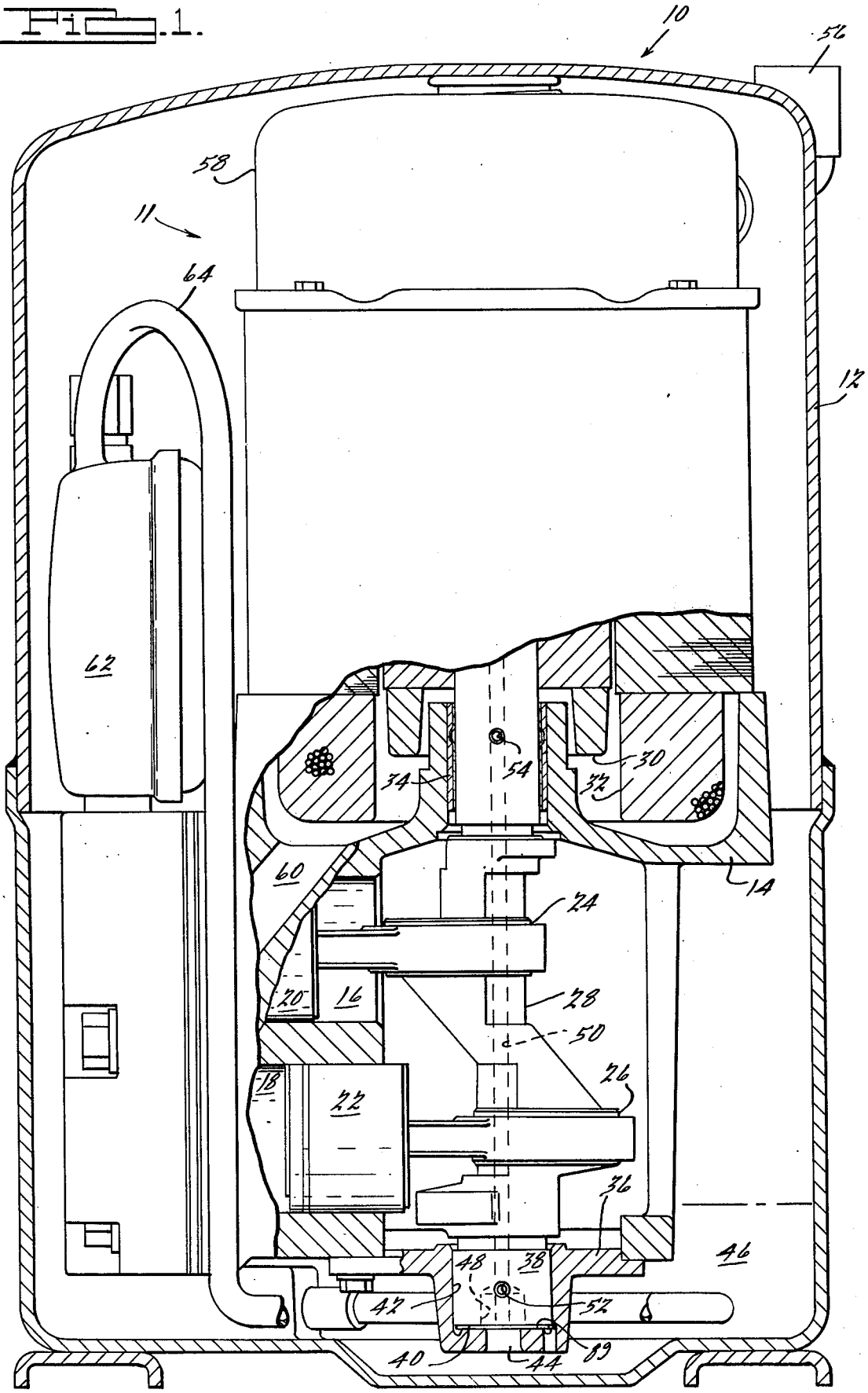
FIG. 1 is a partially sectioned elevational view of a refrigeration compressor in accordance with the present invention having portions thereof broken away.

Referring now to FIG. 1, there is shown a hermetic refrigeration compressor indicated generally at 10 comprising a hermetically sealed outer shell 12 in which is mounted a motor compressor 11 including a housing 14 having cylinders 16 and 18 in which pistons 20 and 22 are reciprocatingly disposed. Pistons 20 and 22 are journaled to throws 24 and 26 of vertically disposed crankshaft 28 so as to be reciprocated within cylinders 16 and 18. Crankshaft 28 has a motor rotor 30 secured to the upper end thereof surrounded by motor stator 32 secured to housing 14 which cooperates with rotor 30 so as to rotatably drive crankshaft 28. Housing 14 is also provided with an upper bearing 34 in which an upper portion of crankshaft 28 is journaled and a lower bearing housing member 36 in which the lower end 38 of crankshaft 28 is journaled. Lower bearing housing member 36 includes both axial and radial thrust bearings 40 and 42 respectively. An axial extending opening 44 is provided in the bottom portion of lower bearing housing 36 which allows lubricant from oil sump 46 provided in the bottom portion of outer shell 12 to flow inwardly to central axially extending bore 48 provided in end 38 of crankshaft 28. An eccentric longitudinally extending passage 50 in crankshaft 28 communicates with central bore 48 so as to cooperate therewith to supply lubricant to both throws 24 and 26 as well as upper bearing 34. A radially extending bore 52 is also provided in crankshaft 28 communicating with central bore 48 to supply lubricant to radial thrust bearing 42 in lower bearing housing 36. In like manner, a radial passage 54 communicates with eccentric bore 50 in crankshaft 28 to supply lubricant to upper bearing 34.

In the particular embodiment illustrated, compressor 10 is provided with a shroud 58 defining a motor compartment enclosing motor stator 32 and rotor 30. Outer shell 12 is provided with a suction gas inlet 56 which conducts suction gas into the interior thereof from which it will be directed through openings in shroud 58 across the motor stator 32 and rotor 30 so as to cool same and thence downwardly through passage 60 provided in housing 14 and into cylinders 16 and 18. Reciprocating pistons 20 and 22 will then compress the refrigerant gas causing it to be expelled into discharge muffler 62 from which it is transmitted through discharge line 64 which extends downwardly through the oil sump 46 and through shell 12.

Figure 2:
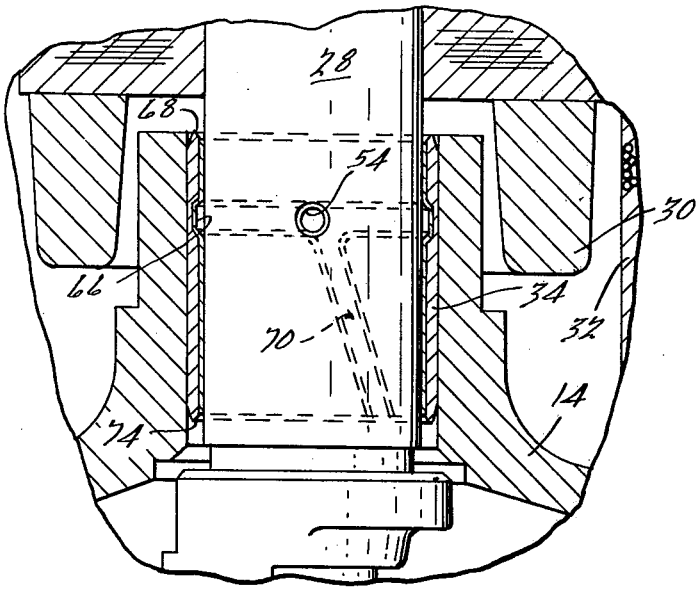
FIG. 2 is an enlarged view of a portion of the refrigeration compressor of FIG. 1 showing the upper bearing and corresponding portion of the crankshaft.
Figure 3:
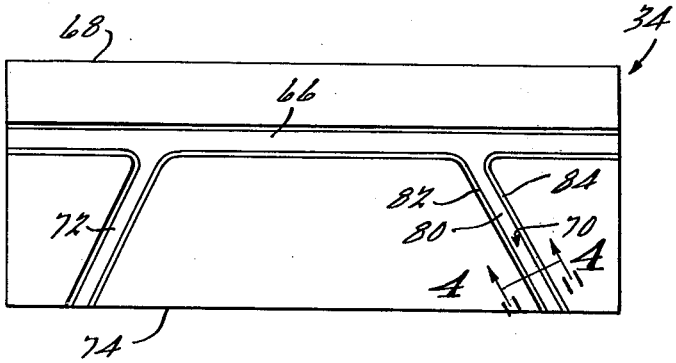
FIG. 3 is a fully developed view of the upper bearing shown in FIGS. 1 and 2.

In order to prevent excess lubricant supplied to upper bearing 34 from being carried through passage 60 into cylinders 16 and 18, it is desirable to provide means associated with upper bearing 34 to return this lubricant directly to oil sump 46. Accordingly, as best seen in FIG. 2, upper bearing 34 is provided with an annular groove 66 spaced slightly below the upper end 68 thereof. A pair of generally axially downwardly extending spiralled grooves 70 and 72 of opposite hand are provided which communicate with annular groove 66 at their upper end and open out the bottom end 74 of bearing 34. While generally axially extending grooves 70 and 72 may be positioned parallel to one another, should this be desired, it will generally be preferable to spiral these grooves in opposite directions so as to disperse the bearing loading forces exerted upon bearing 34. Further, grooves 70 and 72 will preferably be spaced approximately 180° apart and positioned in housing 14 so as to engage crankshaft 28 at points of minimal radial thrust.

Figure 4:
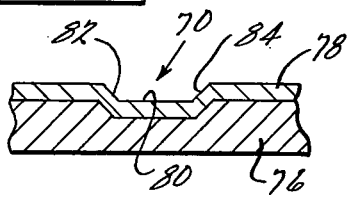
FIG. 4 is a sectioned view of a portion of the bearing of FIG. 3 taken along line 4—4 thereof.

As best seen in FIGS. 2 and 4, upper bearing 34 will preferably be comprised of a base member 76 fabricated from suitable materials such as a low carbon steel for example which has applied to it a layer of bearing material 78 in any suitable manner. As the cross sectional shape of each of grooves 66, 70 and 72 is substantially identical, only a single cross section will be described. As best seen with reference to FIG. 4, groove 70 is defined by a bottom portion 80 and upwardly extending diverging sidewall portions 82 and 84. These grooves may be provided in any suitable manner such as by coining or even cutting the bearing material and/or base member either before or preferably after the bearing material 78 has been applied to the base member. Sidewall portions 82 and 84 are inclined as shown in order to prevent grooves 70 and 72 from acting as lubricant scrapers which would remove the film of oil from rotating crankshaft 28. The depth of grooves 66, 70 and 72 should be sufficient to allow any foreign particles entrained in the oil to pass therethrough without scoring the surface of crankshaft 28.

In operation, lubricant will be conducted from oil sump 46 through opening 44 into bore 48 whereupon centrifugal forces will cause it to flow upwardly through eccentric passage 50 and through radial passage 54 which communicates with annular groove 66 to thereby lubricate upper bearing 34. Annular groove 66 will then direct the lubricating oil around the circumference of bearing 34 with the excess lubricant oil being returned through either passage 70 or 72 directly to the oil sump 46. It should be noted that while only a single spiralled generally axially extending passage 70 or 72 need be provided, it is generally desirable to provide two such passages which are of opposite hand so as to insure that the oil return system thus defined is operative in either direction of rotation of rotor 30 and crankshaft 28.

Often, the lubricant of refrigerant compressors will contain foreign particles such as may be picked up by the refrigerant gas in its circulation through the evaporator and/or condenser or as may be generated from wear during initial running in periods or subsequent operation of the compressor. These foreign particles will generally settle out of the lubricant during periods of non-use but the agitation created by start up as well as entry of slugs of liquid refrigerant will be sufficient to cause some particles to be drawn into the lubricant pumping means. These particles may then be circulated to the bearings resulting in possible scoring or excessive wear of the bearings and/or crank surfaces. Accordingly, compressor 10 is also provided with a means for separating these foreign particles from the lubricant and returning them to the oil sump 46 thereby preventing such particles from damaging the bearings.

Figure 5:
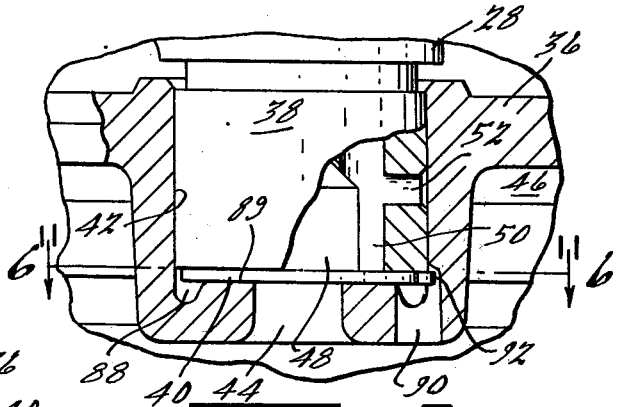
FIG. 5 is an enlarged view of a portion of the lower bearing housing and crankshaft of the refrigeration compressor of FIG. 1.
Figure 6:
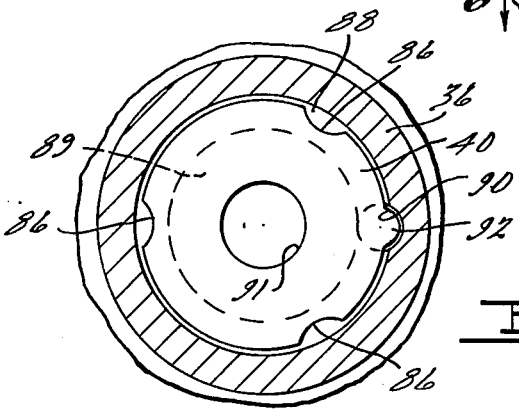
FIG. 6 is a sectioned view of the lower bearing housing of FIG. 5 including the axial thrust bearing, the section being taken along line 6—6 thereof.

As best seen with reference to FIGS. 5 and 6, axial thrust bearing 40 is provided with a plurality of spaced arcuate shaped notches 86 provided around the circumference thereof which open into an annular groove 88 provided in lower bearing housing member 36. As shown therein, annular groove 88 is spaced radially outwardly from central opening 44 provided in lower bearing housing and is generally U-shaped in cross section. Annular groove 88 also acts as a relief groove for machining bearing surface 42 and axial thrust bearing supporting surface 89. A passageway 90 is also provided in lower bearing housing 36 extending between annular groove 88 and oil sump 46. Axial thrust bearing 40 also has a central passage 91 provided therein which aligns with opening 44 in lower bearing housing 36 to allow oil to flow from sump 46 into bore 48. Also, as shown in FIG. 6, axial thrust bearing 40 is provided with a radially outwardly projecting tab portion 92 which is received in and cooperates with an extension of passage 90 so as to prevent rotation of axial thrust bearing 40.

In operation, as best seen in FIG. 5, lubricant which may contain foreign particles will be drawn upwardly from oil sump 46 through bore 44 into central bore 48 of crankshaft 28. Centrifugal force due to the rotation of crankshaft 28 will cause the lubricant to flow radially outwardly from central passage 48 into passage 50 from whence it will be conducted upwardly to lubricate the crankshaft throws 24 and 26 and upper and lower bearings 34 and 42 respectively. As the foreign particles are heavier than the lubricant, they will be caused to separate and to settle downwardly onto the axial thrust bearing 40 or possibly some may be thrown out through radial passage 52 as well. Centrifugal force and the lubricant pressure thus generated will cooperate to flush these foreign particles across the crankshaft engaging surface of axial thrust bearing 40 and bearing surface 42 downwardly through arcuate notches 86 provided on thrust bearing 40 and into annular groove 88. Excess lubricant flow will provide a continuous flushing action which will aid in preventing an excessive build up of particles in annular groove 88 by washing these particles through passage 90 back into oil sump 46 thereby preventing their passage upwardly to throws 24 and 26 and upper bearing 34 so as to protect these bearing surfaces against excessive wear or premature failure. It should be noted that arcuate notches 86 will be of a depth so as to prevent direct communication between eccentric passage 50 and annular groove 88 thereby insuring that adequate oil pressure will be generated by the centrifugal pump arrangement to provide adequate lubrication to both crankshaft throws 24 and 26 as well as upper bearing 34. Further, as a plurality of notches 86 are provided in axial thrust bearing 40, the foreign particles will still be effectively removed from the lubricant even should one or two of these passages become clogged. The continuous flushing action of the lubricant flowing over axial thrust bearing 40 as well as radial thrust bearing 42 and exiting through notches 86 will continuously wash particles across these respective surfaces into annular groove 88 and through passage 90 thereby preventing excessive accumulations therein from defeating the operation of this particle separator.

While it will be apparent that the preferred embodiment of the invention disclosed is well calculated to provide the advantages above stated, it will be appreciated that the invention is susceptible to modification, variation, and change without departing from the proper scope or fair meaning of the subjoined claims.

We claim:

1. A lubrication system for a refrigeration compressor having a housing, compressor means disposed within said housing, a vertical crankshaft provided in said housing and drivingly connected to said compressor means, one end of said crankshaft being journaled in a lower bearing housing associated with said housing, said lower bearing housing having bearing surfaces engaging said crankshaft, said lubrication system comprising:

an oil sump containing lubricant having entrained foreign particles;

lubricant pumping means provided in said crankshaft for supplying lubricant from said sump to said bearing surfaces and said compressor means, said lubricant pumping means being operative to separate said entrained foreign particles from said lubricant flowing to said bearing surfaces and said compressor means;

collecting means provided in said lower bearing housing for receiving said separated foreign particles from said pumping means, said collecting means including an annular groove, and said pumping means being operative to flush said particles into said groove, and passage means provided in said lower bearing housing communicating with said collecting means for returning said separated foreign particles to said oil sump.

2. A lubrication system as set forth in claim 1 wherein said annular groove is continuous.

3. A lubrication system as set forth in claim 1 wherein said annular groove is disposed below said one end of said crankshaft.

4. A lubrication system as set forth in claim 3 further comprising means preventing direct communication between said pump means and said collecting means so as to maintain lubricant pressure in said pump means.

5. A lubrication system as set forth in claim 4 wherein said communication preventing means comprise an axial thrust bearing disposed between said one end of said crankshaft and said annular groove.

6. A lubrication system as set forth in claim 5 wherein said axial thrust bearing has a plurality of axial passages provided therein, said passages being adapted to allow said separated particles to pass from said pump means to said collecting means.

7. A lubrication system as set forth in claim 6 wherein said axial passages comprise a plurality of notches provided in the circumference of said axial thrust bearing.

8. A lubrication system as set forth in claim 5 wherein said axial thrust bearing includes a portion cooperating with said passage means to prevent rotation thereof.

9. A lubrication system as set forth in claim 2 wherein said pumping means comprise intersecting central and eccentric axial passages in said crankshaft, said lower bearing housing having a central opening for placing said central axial passage in communication with said oil sump, said annular groove being concentric with said central opening.

10. A lubrication system as set forth in claim 9 further comprising means preventing direct communication between said eccentric axial passage and said annular groove.

11. A lubrication system for a refrigeration compressor having a housing, compressor means disposed within said housing, a vertical crankshaft provided in said housing and drivingly connected to said compressor means, one end of said crankshaft being journaled in a lower bearing housing associated with said housing, said lower bearing housing having bearing surfaces engaging said crankshaft, said lubrication system comprising:

an oil sump containing lubricant having entrained foreign particles;

lubricant pumping means provided in said crankshaft for supplying lubricant from said sump to said bearing surfaces and said compressor means, said lubricant pumping means being operative to separate said entrained foreign particles from said lubricant flowing to said bearing surfaces and said compressor means, said lubricant pumping means including intersecting central and eccentric axial passages in said crankshaft, said lower bearing housing having a central opening for placing said central axial passage in communication with said oil sump;

collecting means provided in said lower bearing housing for receiving said separated foreign particles from said pumping means, said collecting means including an annular groove, said annular groove being concentric with said central opening, and said pumping means being operative to flush said particles into said groove;

an axial thrust bearing disposed between said annular groove and said one end of said crankshaft for preventing direct communication between said eccentric axial passage and said annular groove, said axial thrust bearing having a plurality of spaced radially inwardly extending notches provided in the circumference thereof, and passage means provided in said lower bearing housing communicating with said collecting means for returning said separated foreign particles to said oil sump, said central and eccentric axial passages cooperating with said notches to flush said separated particles into said annular groove and through said passage means.

12. A lubrication system as set forth in claim 11 wherein said axial thrust bearing has means cooperating with said passage means to prevent rotation thereof.

13. A lubrication system as set forth in claim 12 wherein said rotation preventing means comprise a radially outwardly extending tab portion engaging a portion of said passage means.

* * * * *

UNITED STATES PATENT AND TRADEMARK OFFICE

CERTIFICATE OF CORRECTION

PATENT NO. : 4,153,392

DATED : May 8, 1979

INVENTOR(S) : John P. Elson and Ernest R. Bergman

It is certified that error appears in the above-identified patent and that said Letters Patent are hereby corrected as shown below:

Claim 9, line 1: "2" should be --1--

Signed and Sealed this

*Tenth* Day of *July 1979*

[SEAL]

*Attest:*

LUTRELLE F. PARKER

*Attesting Officer* *Acting Commissioner of Patents and Trademarks*